US006780282B2

(12) United States Patent
Scherb et al.

(10) Patent No.: US 6,780,282 B2
(45) Date of Patent: Aug. 24, 2004

(54) MACHINE AND PROCESS FOR PRODUCING A FIBROUS MATERIAL WEB

(75) Inventors: Thomas Thoroe Scherb, Sao Paulo (BR); Harald Schmidt-Hebbel, Barueri (BR); Karl Steiner, Herbrechtingen (DE)

(73) Assignee: Voith Pater Patent GmbH, Heidenheim (DE)

( * ) Notice: Subject to any disclaimer, the term of this patent is extended or adjusted under 35 U.S.C. 154(b) by 34 days.

(21) Appl. No.: 09/880,061

(22) Filed: Jun. 14, 2001

(65) Prior Publication Data

US 2002/0060046 A1 May 23, 2002

(30) Foreign Application Priority Data

Jul. 3, 2000 (DE) ..... 100 32 251

(51) Int. Cl.[7] ..... D21F 9/00

(52) U.S. Cl. ..... 162/111; 162/206; 162/207; 162/208; 162/358.3; 162/359.1; 162/301

(58) Field of Search ..... 162/109–117, 205–208, 162/358.3, 359.1, 300–301, 308, 310, 314, 376

(56) References Cited

U.S. PATENT DOCUMENTS

| | | | | | |
|---|---|---|---|---|---|
| 1,025,822 | A | | 5/1912 | Millspaugh | |
| 3,224,928 | A | * | 12/1965 | Lee et al. | 162/359.1 |
| 3,691,010 | A | * | 9/1972 | Krake | 162/359.1 |
| 3,821,068 | A | | 6/1974 | Shaw | |
| 4,008,122 | A | * | 2/1977 | Welte | 162/359.1 |
| 4,102,737 | A | * | 7/1978 | Morton | 162/359.1 |
| 4,556,454 | A | * | 12/1985 | Dahl et al. | 162/358.3 |
| 4,563,245 | A | * | 1/1986 | Wanke et al. | 162/358.3 |
| 4,664,359 | A | | 5/1987 | Hertwich | |
| 4,704,192 | A | * | 11/1987 | Cronin | 162/359.1 |
| 5,043,046 | A | * | 8/1991 | Laapotti | 162/358.3 |
| 5,439,559 | A | * | 8/1995 | Crouse | 162/359.1 |
| 5,569,358 | A | | 10/1996 | Cameron | |
| 5,591,305 | A | | 1/1997 | Cameron | |
| 5,709,778 | A | * | 1/1998 | Kade et al. | 162/358.3 |
| 6,083,349 | A | * | 7/2000 | Schiel | 162/358.3 |
| 6,136,146 | A | | 10/2000 | Phan et al. | |
| 6,231,723 | B1 | * | 5/2001 | Kanitz et al. | 162/359.1 |
| 6,235,160 | B1 | * | 5/2001 | Tietz et al. | 162/358.3 |
| 6,540,880 | B1 | | 4/2003 | Trokhan et al. | |

FOREIGN PATENT DOCUMENTS

| | | |
|---|---|---|
| AT | 333584 | 11/1976 |
| EP | 0926296 | 6/1999 |
| EP | 1016754 | 7/2000 |
| WO | 97/03247 | 1/1997 |
| WO | 97/16593 | 5/1997 |
| WO | WO 99/10597 | 4/1999 |
| WO | WO 99/47749 | 9/1999 |

OTHER PUBLICATIONS

European Search Report (in German) dated Aug. 7, 2003 conducted in European Patent Application No. 01 10 7708.

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Machine and process for producing a fibrous material web. The machine includes at least one shoe press having at least one drying cylinder and a shoe press unit which are arranged to form a pressing nip elongated in a web travel direction. At least one suctioned apparatus is arranged before the at least one shoe press relative to the web travel direction, and a water-permeable continuous carrying belt is arranged to guide the fibrous material web over the at least one suctioned apparatus and through the elongated pressing nip. A hood subjected to an overpressure is assigned to the suctioned apparatus and is arranged to support an underpressure effect of the at least one suctioned apparatus. The process includes guiding the fibrous material web and the carrying belt through the elongated pressing nip, and supporting an underpressure effect of the suctioned apparatus by creating an overpressure in the hood.

47 Claims, 2 Drawing Sheets

MACHINE AND PROCESS FOR PRODUCING A FIBROUS MATERIAL WEB

CROSS-REFERENCE TO RELATED APPLICATIONS

The present application claims priority under 35 U.S.C. §119 of German Patent Application No. 100 32 251.4, filed on Jul. 3, 2000, the disclosure of which is expressly incorporated by reference herein in its entirety.

BACKGROUND OF THE INVENTION

1. Field of the Invention

The present invention relates to a machine for producing a fibrous material web, in particular a tissue or hygiene paper web, having at least one shoe press including a drying cylinder and one shoe press unit for forming a pressing nip that is elongated in the web travel direction, with the fibrous material web being guided through the elongated pressing nip along with a water-permeable continuous carrying belt and with the carrying belt being guided over at least one suctioned apparatus before the shoe press in the web travel direction.

The instant invention also relates to a process for producing a fibrous material web, in particular a tissue or hygiene paper in which the fibrous material web, along with a water-permeable continuous carrying belt, is guided through at least one elongated pressing nip of a shoe press including a drying cylinder and a shoe press unit and the carrying belt is guided over at least one suctioned apparatus before the shoe press in the web travel direction.

2. Discussion of Background Information

A machine of the type mentioned at the outset is disclosed in EP-A-0 926 296.

In a tissue machine known from WO 97/03247, a relatively large and expensive TAD (through air drying) unit is provided instead of a shoe press.

SUMMARY OF THE INVENTION

The present invention provides a device and process of the type mentioned at the outset with which the dry content of the tissue is further increased in a volume-saving and cost-effective manner and, correspondingly, the production of tissue can be made more economical.

With regard to the machine, the instant invention includes a hood subjected to overpressure that is assigned to the suctioned apparatus in order to support the underpressure effect of the suctioned apparatus.

Via the hood, which is subjected to overpressure and can be a smaller hood in particular, the underpressure effect of the suctioned apparatus is supported, which improves the runnability of the tissue web, especially at higher speeds. Thus, such a hood can be used particularly advantageously where the speeds are greater than approximately 1800 m/min, preferably greater than approximately 2000 m/min, and in particular greater than approximately 2200 m/min.

Preferably, the carrying belt is guided over the suctioned apparatus along with the fibrous material web, with the fibrous material web lying on the outside.

In a preferred practical embodiment of the machine according to the invention, the suctioned apparatus includes a suction roll.

It is advisable to provide overheated steam and/or dry and/or moist hot air as an overpressure fluid for the hood.

The heating of the fibrous material web caused thereby contributes substantially to increasing dewatering performance in the subsequent elongated pressing nip. Here, even an increase in web moisture by the moist hot air can be accepted. Moreover, the steam and the dry hot air also intensify the drying in the region of the suctioned apparatus.

It is advantageous for an additional suctional element to be provided between the suctioned apparatus and the shoe press. In this manner, the dry content is increased further because this additional suction element prevents the back flow of the water from the carrying belt into the tissue web caused by capillary action. This suction element can, in particular, include a suction box.

The shoe press unit advantageously has several pressing zones, at least crosswise to the web travel direction, that are adjustable independently of one another.

In a useful practical embodiment, the drying cylinder is provided as a tissue or Yankee drying cylinder from which the fibrous material web can be scraped after drying has occurred by a crepe doctor.

It is advantageous for the carrying belt to be provided in a forming section for accepting the fibrous stock suspension from a headbox.

Here, it is advisable to guide the carrying belt as the inner belt over a forming roll or the like, over which at least one continuous outer wire is guided.

In a useful practical embodiment of the machine according to the invention, a felt belt is provided as the carrying belt and/or the inner belt.

Thus, especially an embodiment as a crescent former with a felt belt provided as an inner wire is possible. The use of an additional suction element arranged between the suctioned apparatus and the shoe press is particularly advantageous in such an arrangement.

In another useful embodiment, a wire belt, for example, a dewatering belt, is provided as the carrying and/or inner belt. In this case, an additional continuous felt belt arranged between the carrying belt and the shoe press unit is guided along with the fibrous material web and the carrying belt through the elongated pressing nip, whereby markings are prevented and dewatering is supported or even deliberately produced, in particular when the carrying belt is an imprinting wire or felt.

The shoe press unit is preferably provided with a water-impermeable circulating endless pressing belt. Here, the shoe press unit can, in particular, be formed by a shoe press roll with a pressing jacket, preferably a water-impermeable pressing jacket.

Otherwise, the shoe press can, in particular, be embodied as described in DE-A-99 125 789.0, the disclosure of which is expressly incorporated by reference herein in its entirety.

The process according to the invention is correspondingly characterized in that the underpressure effect of the suctioned apparatus is supported by an overpressurized hood that is assigned to one of the suctioned apparatuses.

The arrangement and process according to the invention can be used in particular in tissue machines of various embodiments, for example, for suction breast roll formers, double wire formers, crescent formers, fourdrinier wires, etc. Moreover, a combination with through air drying concepts is advantageous.

The present invention is directed to a machine for producing a fibrous material web that includes at least one shoe press having at least one drying cylinder and a shoe press unit which are arranged to form a pressing nip elongated in a web travel direction. At least one suctioned apparatus is arranged before the at least one shoe press relative to the web travel direction, and a water-permeable continuous carrying belt is arranged to guide the fibrous material web over the at least one suctioned apparatus and through the elongated pressing nip. A hood subjected to an overpressure is assigned to the suctioned apparatus and is arranged to support an underpressure effect of the at least one suctioned apparatus.

In accordance with a feature of the instant invention, the fibrous material web can include a tissue or hygiene paper web.

According to another feature of the invention, as the carrying belt guides the fibrous material web over the suctioned apparatus, the carrying belt can be arranged between the fibrous material web and the suctioned apparatus.

The present invention also provides that the suctioned apparatus may include a suction roll.

The hood can contain an overpressure fluid comprising at least one of overheated steam and dry and/or moist hot air.

Further, a suction element can be positioned between the suctioned apparatus and the at least one shoe press. The suction element can include a suction box.

The at least one shoe press unit may include a plurality of pressing zones arranged crosswise to the web travel direction. Further, the plurality of pressing zones may be controllable independently of one another.

Moreover, the drying cylinder can include a tissue or Yankee drying cylinder, and the machine further may further include a crepe doctor arranged to remove the fibrous material web from the tissue or Yankee drying cylinder after drying.

In accordance with still another feature of the instant invention, the machine may include a forming section in which the carrying belt can be arranged to accept a fibrous stock suspension from a headbox.

Still further, a forming roll and a continuous outer wire may be provided. The carrier belt can also guided over the forming roll as an inner belt over a forming roll in relation to the continuous outer wire. Further, the inner belt may include a felt belt, a wire belt, a dewatering belt, or an imprinting member.

According to a still further feature of the present invention, the carrier belt can include a felt belt, a wire belt, a dewatering belt, or an imprinting member.

The machine in accordance the instant invention can further include an additional continuous felt belt which is arranged between the carrying belt and the shoe press unit and which is guided through the elongated pressing nip along with the fibrous material web and the carrying belt.

The one shoe press unit may include a water-impermeable continuous, circulating press belt.

Moreover, the shoe press unit can include a shoe press roll with a pressing jacket. The pressing jacket may include a water-impermeable pressing jacket.

The present invention is directed to a process for producing a fibrous material web in an apparatus including a water-permeable continuous carrying belt, at least one shoe press having an elongated pressing nip formed between a drying cylinder and a shoe press unit, at least one suctioned apparatus, which includes a hood, arranged before the at least one shoe press unit relative to a web travel direction, and a carrying belt guided over the at least one suctioned apparatus. The process includes guiding the fibrous material web and the carrying belt through the elongated pressing nip, and supporting an underpressure effect of the suctioned apparatus by creating an overpressure in the hood.

According to a feature of the instant invention, as the carrying belt guides the fibrous material web over the suctioned apparatus, the carrying belt can be positioned between the suctioned apparatus and the fibrous material web.

In accordance with another feature of the present invention, the suctioned apparatus may include a suction roll.

According to the process of the invention, the overpressure in the hood can be created by an overpressure fluid comprising at least one of overheated steam and dry and/or moist hot air.

Moreover, the apparatus can further include a suction element positioned between the suctioned apparatus and the at least one shoe press, and process may further include suctioning the carrying belt and fibrous material web guided over the suction element.

In accordance with still another feature of the present invention, the suction element may include a suction box.

Further, the shoe press unit can include a plurality of pressing zones arranged at least crosswise to the web travel direction, and the process may further include independently controlling the plurality of pressing zones.

The drying cylinder can include a tissue or Yankee drying cylinder, and the process may include scraping the fibrous material web from the tissue or Yankee drying cylinder after drying. Further, the apparatus can include a crepe doctor and the process may further include scraping the fibrous material web from the tissue or Yankee drying cylinder after drying with the crepe doctor.

In accordance with a further feature of the invention, the apparatus can include a forming section and the carrying belt can be guided through the forming section, and the process may include accepting a fibrous material suspension from a headbox on the carrying belt.

Still further, the apparatus may include a forming roll with a continuously outer wire, and the carrying belt may be guided over the forming roll as an inner wire between the continuous outer wire and the forming roll, and the process can include supplying a fibrous material suspension between the inner wire and the outer wire. Further, the inner belt may include a felt belt, a wire belt, a dewatering belt, or an imprinting member.

Further, in the process of the instant invention, the carrier belt may include a felt belt, a wire belt, a dewatering belt, or an imprinting member.

The apparatus can include an additional continuous felt belt arranged between the carrying belt and the shoe press unit in the elongated pressing nip, and the process may include guiding the fibrous material web through the elongated pressing nip along with the carrying belt and the additional continuous felt belt.

According to the process of instant invention, the shoe press unit can include a water-impermeable pressing belt.

In accordance with a feature of the process of the present invention, the shoe press unit can include a pressing jacket. Further, the pressing jacket may include a water-impermeable pressing jacket.

The present invention is directed to an apparatus for producing a fibrous material web that includes at least one shoe press including at least one drying cylinder and a shoe press unit which are arranged to form a pressing nip elongated in a web travel direction. At least one suctioned apparatus is arranged before the at least one shoe press relative to the web travel direction, and an overpressure device is associated with the at least one suctioned apparatus arranged to support an underpressure effect of the at least one suctioned apparatus.

According to a feature of the instant invention, the overpressure device may include a hood subjected to an overpressure, which can be arranged to surround at least a portion of the at least one suctioned apparatus.

In accordance with yet another feature of the present invention, the overpressure device can include an overpressure fluid comprising at least one of overheated steam and dry and/or moist hot air.

The present invention is directed to a process for producing a fibrous material web in an apparatus that includes at least one shoe press having at least one drying cylinder and a shoe press unit which are arranged to form a pressing nip elongated in a web travel direction, at least one suctioned apparatus arranged before the at least one shoe press relative to the web travel direction, and an overpressure device associated with the at least one suctioned apparatus. The process includes guiding the fibrous material web over the at least one suctioned apparatus, and subjecting the fibrous material web to an overpressure while is it guided over the at least one suctioned apparatus.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
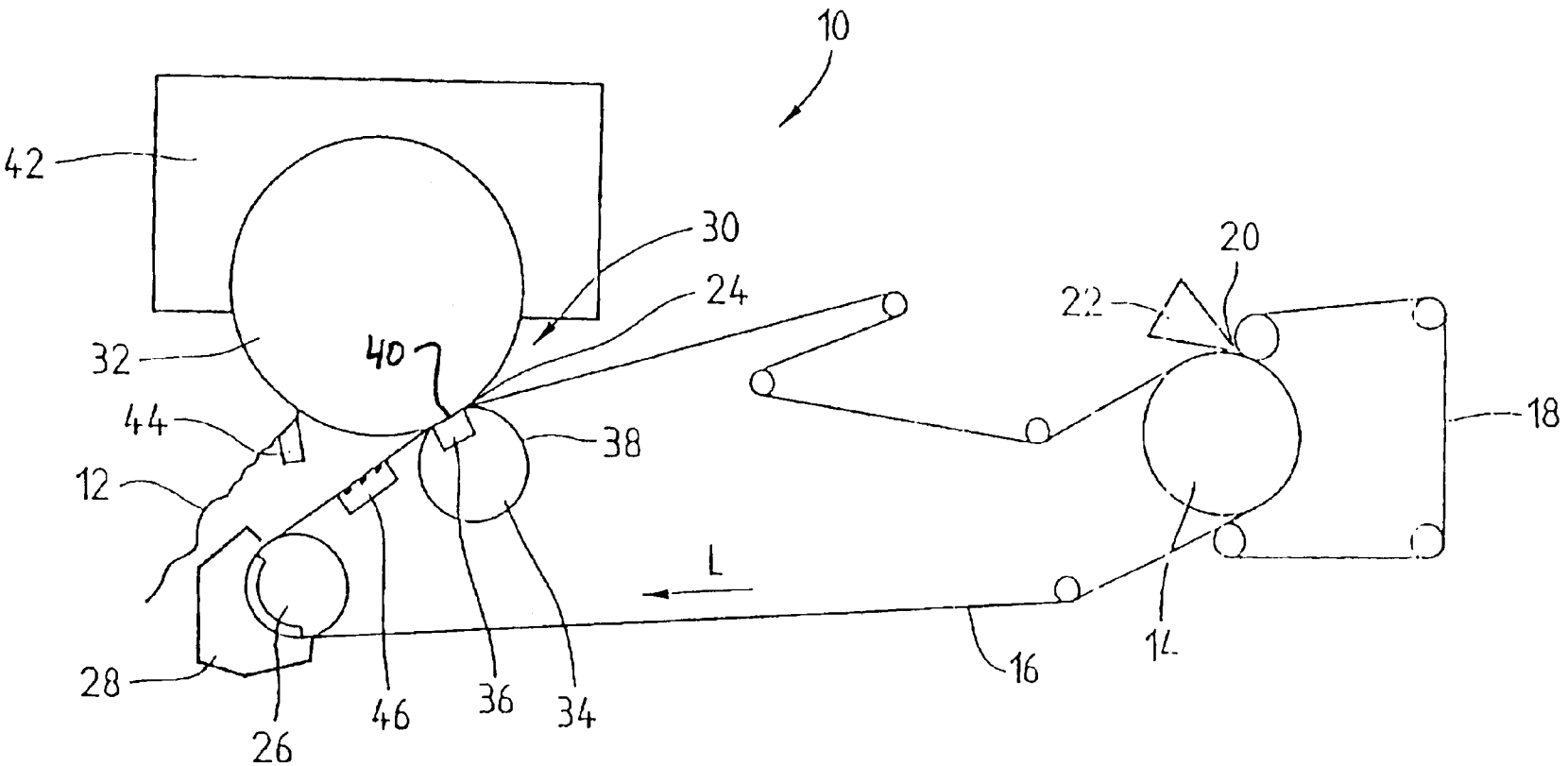
FIG. 1 illustrates a schematic partial depiction of a machine for producing a tissue or hygiene paper web that is embodied as a crescent former and provided with an inner felt belt.

FIG. 1 shows in a schematic partial view a machine 10 embodied as a crescent former for producing a fibrous material web 12, which can be, in particular, a tissue or hygiene paper web.

Here, a continuous inner or carrying belt 16 and a continuous outer wire 18 are guided together over a region of a so-called forming roll 14. As can be seen in FIG. 1, the wrapping angle with regard to outer wire 18 is less than the wrapping angle with regard to carrying belt 16 located to the inside.

In inlet nip 20 formed between carrying belt 16 and outer wire 18, the fibrous stock suspension is added by a headbox 22. After the wrapping region of forming roll 14, fibrous material web 12 being formed is guided along with carrying belt 16 to a pressing nip 24 elongated in a web travel direction L.

Before reaching elongated pressing nip 24, carrying belt 16 guiding fibrous material web 12 wraps a suctioned apparatus, embodied here as a suction roll 26. Suction roll 26 removes a substantial portion of the water from carrying belt 16 and possibly removes some from outlying fibrous material web 12 as well.

In the present exemplary embodiment, carrying belt 16 is provided as a felt belt.

Via suction roll 26, the water absorption capabilities of carrying belt 16 are increased so that, in the subsequent elongated pressing nip 24 through which it travels along with fibrous material web 12, it can absorb the water that is pressed out.

The underpressure effect of suction roll 26 is supported by a hood 28 that is subjected to overpressure and assigned to suction roll 26. As a rule, a small hood is sufficient in this case. In the present case, carrying belt 16 is guided over suction roll 26 with fibrous material web 12 facing outwards.

Overheated steam and/or dry and/or moist hot air is provided as the overpressure fluid for hood 28.

Through this arrangement, the dewatering is intensified in such a way that it is sufficient to use only one pressing nip 24.

Shoe press 30 forming elongated pressing nip 24 includes a drying cylinder 32 serving as a tissue or Yankee drying cylinder and a shoe press unit 34 with at least one press shoe 36 and a continuous circulating press belt 38 guided over them. In the present case, shoe press unit 34 is formed by a shoe press roll with a flexible, preferably water-impermeable, pressing jacket 38.

Press shoe 36 has a pressing surface 40 that is at least essentially concave. The pressing can occur hydraulically, for example. The region between flexible pressing jacket 38 and press shoe 36 can be lubricated, in particular hydrostatically or hydrodynamically.

Shoe pressing unit 34 preferably has several pressing zones crosswise to the web travel direction L that can be controlled independently of one another, which allows an adaptation to the sagging of drying cylinder 32 as well as the setting of a desired pressing pressure profile crosswise to the web travel direction L.

Pressing nip 24 running in the web travel direction L allows an intense and yet volume-saving dewatering of fibrous material web 12.

After elongated pressing nip 24, fibrous material web 12 runs along heated drying cylinder 32. The drying is further intensified in this wrapping region by a drying hood 42, which blows the hot, dry air onto fibrous material web 12 and suctions it off again.

After drying has occurred, fibrous material web 12 is removed from drying cylinder 32 by a crepe doctor 44. Creped fibrous material web 12 can subsequently be further processed and wound.

In the present case, an additional suction element is provided between suction roll 26 and shoe press 30; this suction element can be formed, for example, by a suction box 46 or the like. By this additional suction box 46, the dry content is further increased because the back flow of the water from carrying belt 16 into fibrous material web 12 caused by capillary action is prevented.

Figure 2:
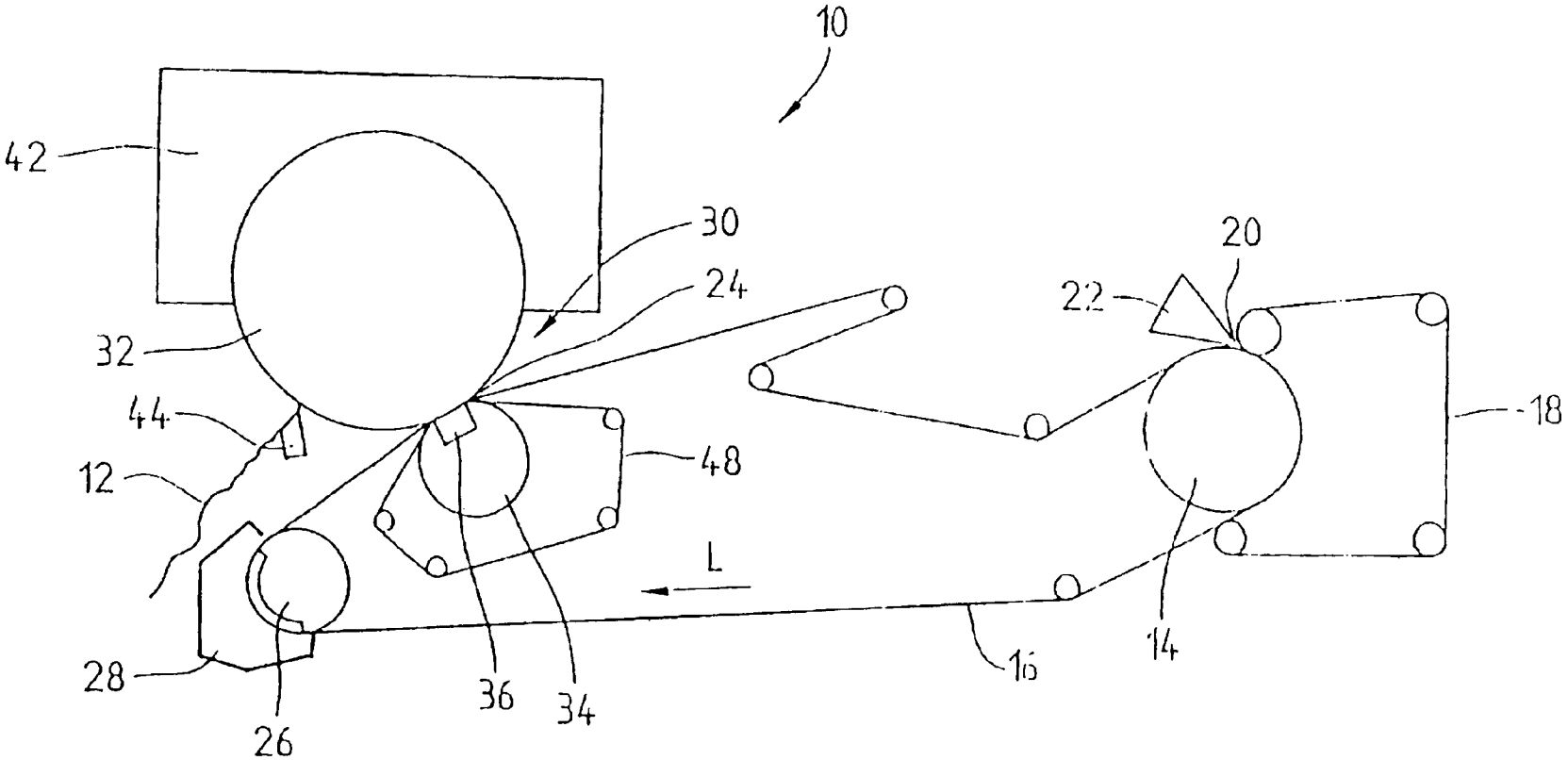
FIG. 2 illustrates a schematic partial depiction of a machine for producing a tissue or hygiene paper web that is provided with an inner wire.

FIG. 2 shows a schematic partial view of another exemplary embodiment of a machine 10 for producing a fibrous material web 12, which again can particularly be a tissue or hygiene paper web.

This embodiment differs from that of FIG. 1 initially in that a wire belt, for example, a dewatering belt, is provided instead of a felt belt as the carrying and/or inner belt 16. In this case, an additional continuous felt belt 48 arranged between carrying belt 16 and shoe press unit 34 is fed through elongated pressing nip 24 along with fibrous material web 12 and carrying belt 16 for the purpose of preventing markings and supporting or even deliberately producing dewatering, in particular when the carrying belt is an imprinting wire or felt.

Additional suction element 46 provided between suction roll 26 and shoe press 30 in the embodiment according to FIG. 1 is omitted in the present case.

Otherwise, the embodiment shown in FIG. 2 has at least essentially the same construction as that of FIG. 1. Corresponding parts have been given the same reference characters.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Machine
12 Fibrous material web
14 Forming roll
16 Continuous inner or carrying belt
18 Continuous outer wire
20 Inlet nip
22 Headbox
24 Elongated pressing nip
26 Suction roll
28 Overpressure hood
30 Shoe press
32 Drying cylinder
34 Shoe press unit
36 Pressing shoe
38 Pressing jacket
40 Concave pressing surface
42 Drying hood
44 Crepe doctor
46 Suction box
48 Felt belt
L Web travel direction

What is claimed is:

1. A machine for producing a tissue or hygiene web comprising:

at least one shoe press including at least one drying cylinder and a shoe press unit which are arranged to form a pressing nip elongated in a web travel direction;

at least one suctioned apparatus arranged before said at least one shoe press relative to the web travel direction;

a water-permeable continuous carrying belt arranged to guide the tissue or the hygiene web from a forming roll over said at least one suctioned apparatus and through said elongated pressing nip; and a hood subjected to an overpressure being assigned to said at least one suctioned apparatus and being arranged to support an underpressure effect of said at least one suctioned apparatus, wherein the at least one suctioned apparatus comprises a suction roll and wherein the hood at least partially surrounds the suction roll, and wherein the tissue or the hygiene web travels at a speed that is greater than approximately 1800 m/min.

2. The machine in accordance with claim 1, wherein, as said carrying belt guides the tissue or the hygiene web over said at least one suctioned apparatus, said carrying belt is arranged between the tissue or the hygiene web and said at least one suctioned apparatus.

3. The machine in accordance with claim 1, wherein said hood contains an overpressure fluid comprising at least one of overheated steam and dry and moist hot air.

4. The machine in accordance with claim 1, further comprising a suction element positioned between said at least one suctioned apparatus and said at least one shoe press.

5. The machine in accordance with claim 4, wherein said suction element comprises a suction box.

6. The machine in accordance with claim 1, wherein said at least one shoe press unit comprises a plurality of pressing zones arranged crosswise to the web travel direction.

7. The machine in accordance with claim 6, wherein said plurality of pressing zones are controllable independently of one another.

8. The machine in accordance with claim 1, wherein said at least one drying cylinder comprises a tissue or Yankee drying cylinder, and said machine further comprises a crepe doctor arranged to remove the tissue or the hygiene web from said tissue or Yankee drying cylinder after drying.

9. The machine in accordance with claim 1, wherein the machine includes a forming section in which said carrying belt is arranged to accept a fibrous stock suspension from a headbox.

10. The machine in accordance with claim 1, further comprising a continuous outer wire, wherein said carrying belt is also guided over said forming roll as an inner belt over the forming roll in relation to said continuous outer wire.

11. The machine in accordance with claim 10, wherein said inner belt comprises a felt belt.

12. The machine in accordance with claim 10, wherein said inner belt comprises a wire belt.

13. The machine in accordance with claim 10, wherein said inner belt comprises a dewatering belt.

14. The machine in accordance with claim 10, wherein said inner belt comprises an imprinting member.

15. The machine in accordance with claim 1, wherein said carrying belt comprises a felt belt.

16. The machine in accordance with claim 1, wherein said carrying belt comprises a wire belt.

17. The machine in accordance with claim 1, wherein said carrying belt comprises a dewatering belt.

18. The machine in accordance with claim 1, wherein said carrying belt comprises an imprinting member.

19. The machine in accordance with claim 1, further comprising a continuous felt belt which is arranged between said carrying belt and said shoe press unit and which is guided through said elongated pressing nip along with the tissue or the hygiene web and said carrying belt.

20. The machine in accordance with claim 1, wherein said shoe press unit comprises a water-impermeable continuous, circulating press belt.

21. The machine in accordance with claim 1, wherein said shoe press unit comprises a shoe press roll with a pressing jacket.

22. The machine in accordance with claim 21, wherein said pressing jacket comprises a water-impermeable pressing jacket.

23. A process for producing a tissue or hygiene web in an apparatus including a water-permeable continuous carrying belt, at least one shoe press having an elongated pressing nip formed between a drying cylinder and a shoe press unit, at least one suctioned apparatus that includes a suction roll, a hood that at least partially surrounds the suction roll, the at least one suctioned apparatus being arranged before the at least one shoe press unit relative to a web travel direction, and said carrying belt being guided from a forming roll and then over the suction roll, said process comprising:

guiding the tissue or the hygiene web and the carrying belt through the elongated pressing nip; and supporting an underpressure effect of the suction roll by creating an overpressure in the hood, wherein the tissue or the hygiene web travels at a speed that is greater than approximately 1800 m/min.

24. The process in accordance with claim 23, wherein, as the carrying belt guides the tissue or the hygiene web over the at least one suctioned apparatus, the carrying belt is positioned between the at least one suctioned apparatus and the tissue or the hygiene web.

25. The process in accordance with claim 23, wherein the overpressure in the hood is created by an overpressure fluid comprising at least one of overheated steam and dry and/or moist hot air.

26. The process in accordance with claim 23, wherein the apparatus further includes a suction element positioned between the at least one suctioned apparatus and the at least one shoe press, and process further comprises suctioning the carrying belt and the tissue or the hygiene web guided over the suction element.

27. The process in accordance with claim 26, wherein said suction element comprises a suction box.

28. The process in accordance with claim 23, wherein the shoe press unit comprises a plurality of pressing zones arranged at least crosswise to the web travel direction, and the process further comprises independently controlling the plurality of pressing zones.

29. The process in accordance with claim 23, wherein the drying cylinder comprises a tissue or Yankee drying cylinder, and the process further comprises scraping the tissue or the hygiene web from the tissue or Yankee drying cylinder after drying.

30. The process in accordance with claim 29, wherein the apparatus further includes a crepe doctor and the process comprises scraping the tissue or the hygiene web from the tissue or Yankee drying cylinder after drying with the crepe doctor.

31. The process in accordance with claim 23, wherein the apparatus includes a forming section and the carrying belt is guided through the forming section, and the process further comprises accepting a fibrous material suspension from a headbox on the carrying belt.

32. The process in accordance with claim 23, wherein the apparatus further includes a continuous outer wire, and the carrying belt is guided over the forming roll as an inner wire between the continuous outer wire and the forming roll, and the process further includes supplying a fibrous material suspension between the inner wire and the outer wire.

33. The process in accordance with claim 32, wherein said inner belt comprises a felt belt.

34. The process in accordance with claim 32, wherein said inner belt comprises a wire belt.

35. The process in accordance with claim 32, wherein said inner belt comprises a dewatering belt.

36. The process in accordance with claim 32, wherein said inner belt comprises an imprinting member.

37. The process in accordance with claim 23, wherein said carrying belt comprises a felt belt.

38. The process in accordance with claim 23, wherein said carrying belt comprises a wire belt.

39. The process in accordance with claim 23, wherein said carrying belt comprises a dewatering belt.

40. The process in accordance with claim 23, wherein said carrying belt comprises an imprinting member.

41. The process in accordance with claim 23, wherein the apparatus includes a continuous felt belt arranged between the carrying belt and the shoe press unit in the elongated pressing nip, and the process further includes guiding the tissue or the hygiene web through the elongated pressing nip along with the carrying belt and the additional continuous felt belt.

42. The process in accordance with claim 23, wherein the shoe press unit comprises a water-impermeable pressing belt.

43. The process in accordance with claim 23, wherein the shoe press unit comprises a pressing jacket.

44. The process in accordance with claim 23, wherein the pressing jacket comprises a water-impermeable pressing jacket.

45. An apparatus for producing a tissue or hygiene web comprising:

at least one shoe press including at least one drying cylinder and a shoe press unit which are arranged to form a pressing nip elongated in a web travel direction;

at least one suctioned apparatus arranged before said at least one shoe press relative to the web travel direction;

a water-permeable continuous carrying belt arranged to guide the tissue or the hygiene web from a forming roll over said at least one suctioned apparatus and through said pressing nip; and an overpressure device associated with said at least one suctioned apparatus arranged to support an underpressure effect of said at least one suctioned apparatus, wherein the at least one suctioned apparatus comprises a suction roll and wherein the overpressure device comprises a hood subjected to an overpressure, the hood being arranged to surround at least a portion of the suction roll, and wherein the tissue or the hygiene web travels at a speed that is greater than approximately 1800 m/min.

46. The apparatus in accordance with claim 45, wherein said overpressure device comprises an overpressure fluid comprising at least one of overheated steam, dry air and moist hot air.

47. A process for producing a tissue or hygiene web in an apparatus that includes at least one shoe press having at least one drying cylinder and a shoe press unit which are arranged to form a pressing nip elongated in a web travel direction, at least one suctioned apparatus arranged before the at least one shoe press relative to the web travel direction, and an overpressure device associated with the at least one suctioned apparatus, wherein the at least one suctioned apparatus comprises a suction roll and wherein the overpressure device comprises a hood subjected to an overpressure, the hood being arranged to surround at least a portion of the suction roll, the process comprising:

guiding the tissue or the hygiene web from a forming roll and over the at least one suctioned apparatus; and subjecting the tissue or the hygiene web to an overpressure while it is guided over the at least one suctioned apparatus, wherein the tissue or the hygiene web travels at a speed that is greater than approximately 1800 m/min.

* * * * *